US012297037B2

(12) United States Patent
Hendrikx et al.

(10) Patent No.: US 12,297,037 B2
(45) Date of Patent: May 13, 2025

(54) PRODUCT FOR PREPARING A BEVERAGE, USE THEREOF AND METHOD OF PRODUCING

(71) Applicant: Faeig B.V., Venlo (NL)

(72) Inventors: Ruud Louis Johannes Hendrikx, Venlo (NL); Mattheus Henricus Gertruda Gipmans, Venlo (NL)

(73) Assignee: Faeig B.V., Venlo (NL)

( * ) Notice: Subject to any disclaimer, the term of this patent is extended or adjusted under 35 U.S.C. 154(b) by 83 days.

(21) Appl. No.: 17/923,311

(22) PCT Filed: Apr. 28, 2021

(86) PCT No.: PCT/NL2021/050277

§ 371 (c)(1),
(2) Date: Nov. 4, 2022

(87) PCT Pub. No.: WO2021/225435

PCT Pub. Date: Nov. 11, 2021

(65) Prior Publication Data

US 2023/0242332 A1 Aug. 3, 2023

(30) Foreign Application Priority Data

May 4, 2020 (NL) ..... 2025491

(51) Int. Cl.
*B65D 85/812* (2006.01)

(52) U.S. Cl.
CPC ..... *B65D 85/812* (2013.01); *B65D 2585/08* (2013.01)

(58) Field of Classification Search
CPC ..... B65D 85/812; B65D 85/808; B65D 2585/08; A47G 21/004
(Continued)

(56) References Cited

U.S. PATENT DOCUMENTS 1,313,582 A * 8/1919 Cowan ..... A47J 31/02 99/323
2,102,920 A * 12/1937 Savage ..... B67D 3/0019 426/660

(Continued)

FOREIGN PATENT DOCUMENTS

CN 106241082 A 12/2016
KR 101146646 B1 5/2012

(Continued)

OTHER PUBLICATIONS

International Search Report (ISR) for PCT/NL2021/050277 mailed Jul. 6, 2021 (5 pages).

(Continued)

*Primary Examiner* — Chun Hoi Cheung

(74) *Attorney, Agent, or Firm* — Myers Bigel, P.A.

(57) ABSTRACT

The invention provides a product for preparing a beverage for consumption and a method for producing such a product. The product comprises a tubular casing which is at least partly made of a material permeable to liquid, an internal space provided on the inside of the casing, a first retaining body and a second retaining body which are also provided on the inside of the casing and delimit the internal space on mutually opposite ends thereof, as well as flavoring material for preparing a beverage. The flavoring material is provided in the internal space and, when immersed in the liquid, such as water, releases flavorings into the liquid for the purpose of preparing the beverage.

20 Claims, 4 Drawing Sheets

Figure 1:
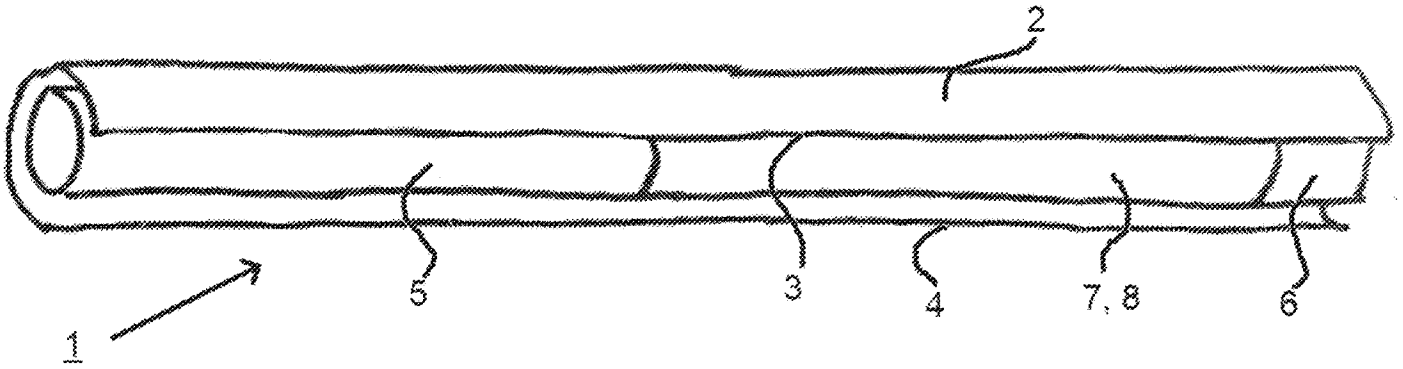

(58) Field of Classification Search
USPC ..... 206/0.5; 99/295
See application file for complete search history.

(56) References Cited

U.S. PATENT DOCUMENTS 3,102,465 A * 9/1963 Montesano ..... A47G 19/16 206/0.5
3,154,418 A * 10/1964 Lovell ..... A47G 21/004 206/568
3,193,388 A * 7/1965 Conrey ..... A47G 19/16 426/77
4,211,156 A * 7/1980 Zimmermann ..... A47J 31/06 206/0.5
4,338,338 A * 7/1982 Popkes ..... A47G 21/004 426/77
4,387,809 A 6/1983 Botzler
4,860,929 A * 8/1989 Lowe ..... A47G 21/004 426/77
5,125,534 A * 6/1992 Rose ..... A47G 21/004 426/115
5,623,865 A * 4/1997 Sidiropoulos ..... B65D 85/812 426/77
5,809,868 A * 9/1998 Milone ..... B65D 85/8085 99/287
8,701,550 B2 * 4/2014 Teng ..... A47J 31/0636 99/323
9,988,205 B2 6/2018 Foss et al.
2008/0171110 A1 * 7/2008 Stuart ..... A47G 21/004 206/0.5
2016/0007795 A1 * 1/2016 Zhang ..... B65D 85/812 99/295

FOREIGN PATENT DOCUMENTS

WO WO-2010055979 A1 * 5/2010 ..... B65D 85/812
WO WO-2010128716 A1 * 11/2010 ..... B65D 85/8085

OTHER PUBLICATIONS

Written Opinion (WO) for PCT/NL2021/050277 mailed Jul. 6, 2021 (9 pages).

* cited by examiner

PRODUCT FOR PREPARING A BEVERAGE, USE THEREOF AND METHOD OF PRODUCING

The present invention relates to a product for preparing a beverage for consumption. In this case, the invention concerns, in particular, but not exclusively, the preparation of tea, such as black tea, green tea, herbal tea, rooibos tea and other hot beverages which are known as teas. As the enumeration already shows, the term tea in the present description should not be interpreted as being limited to a beverage which is prepared by adding heated water to dried leaves of the tea plant (Camillia Senensis) with the leaves imparting flavor to the water. This description also applies to, for example, a beverage which is prepared by adding heated water to herbs, which beverage is also referred to by the terms herb tea or hot infusion. The invention also concerns the preparation of so-called cold infusions. In order to prepare tea, it is generally known to use a tea bag which contains flavorings, such as tea leaves. The International patent application WO 2010/128716 A1 describes an alternative product for a tea bag which product has a cylindrical shape.

The present invention aims to provide an alternative product for preparing a beverage which can be produced on a large scale in a relatively simple way and offers an advantageous user experience for the consumer. To this end, the invention offers a product as claimed in claim 1. The tubular shape of the casing offers a consumer the possibility to use the product as a stirrer element, as a result of which no small spoon or the like, optionally of the single-use type, is required to stir additives, such as milk, sugar or honey, into the beverage, if desired. In addition, the degree to which the consumer can control the degree to which flavorings are released into the liquid is improved due to the intensity with which the consumer stirs the product in the liquid. The permeability to liquid of a material should be understood to mean that the type of material involves the provision of a plurality of passages or openings therein, through which liquid can pass, such as with a gauze or fiber, or that it is a material which was initially closed, but has been made permeable to liquid by providing openings therein, for example by means of perforations. In this case, the individual openings may, for example, have a shape and size such that they fit in a circle having a diameter of a size between 0.05 mm and 0.75 mm or more specifically between 0.10 mm and 0.50 mm. In this case, the degree to which liquid is allowed to pass has to be such that the product is suitable for preparing a beverage within a time frame similar to the time frame which is involved at the moment when preparing a similar beverage according to the Prior Art. Typically, such a time frame is only a few minutes, for example at most five minutes. With a longer time frame, the beverage would otherwise have cooled down too much already in the case of hot beverages. An optionally used gauze as liquid-permeable material may in this case have a regular pattern of openings, but may also have an irregular pattern, as is the case with nonwoven filter material which comprises entangled fibers. Furthermore, a material may be permeable to liquid due to the liquid-absorbing properties of the material which, as such, are again related to the openings in the material which are present in the material due to the nature of the material. In this case, for example, consideration may be given to the paper filter material such as is known from the widely known coffee filters. Contrary to tea bags, the product may retain its shape after being immersed in liquid and thus maintain an attractive appearance. In addition, the use of the casing with the two retaining bodies offers the possibility of producing the product using machines and techniques which are already known from the tobacco and cigarette filter industry for producing cigarettes or at least filters for cigarettes. The invention offers the possibility to produce products according to the invention on production lines which were originally designed to produce cigarettes, for example at rates of up to 20,000 products per minute. The respective production lines will only have to be modified to a limited degree to this end. Examples of machines which could be used for producing products according to the invention, optionally with relatively small modifications thereto, are the Hauni Decoufle Nano-type cigarette machines, Hauni Protos-type cigarette machines, ITM-8.000, G.D. 121-type cigarette machines, or a combination of cigarette machine having a flexible multi-segment filter combiner, such as for example the Solaris manufactured by ITM from Kampen and the Hauni KDf6Mf and the Hauni KDf 5Mf 5,000 manufactured by the German company Hauni Maschinenbau GmbH.

American publication U.S. Pat. No. 4,387,809 describes a tubular combined packaging and stirring device which is provided with two compartments. In the wall of the tubular shape, an opening is provided for every compartment via which the contents, such as sugar or powdered milk, can be spread out of the respective compartment. Paper, plastic and generally preferably a material which is coated with a moisture barrier material are suggested as material for the wall of the tubular shape. In any case, the kind of suggested material is not such that it should be regarded as being liquid permeable in the sense of claim 1. In U.S. Pat. No. 4,387,809, exactly the opposite is aimed for, namely to prevent that liquid gets into one of the compartments via the material of the tube wall.

In one embodiment, the casing has a length which is equal to the length of the product. This property benefits the rigidity of the product, in particular if the casing is made as a single piece according to a further embodiment.

From the point of view of efficient use of material, but also for production-engineering reasons, it may be advantageous if the casing comprises at least two partial casings.

The abovementioned advantage may be relevant, in particular, if at least one, preferably each, of the at least two partial casings has a length which is smaller than the length of the product and/or if at least two of the at least two partial casings overlap one another for only a part of their respective lengths.

In case there is an overlap of two partial casings, in one embodiment, the two overlapping partial casings are connected to each other at the location of the overlap. Such a connection may be brought about, for example, by means of adhesive bonding, ultrasonic sealing or heat-sealing.

In a further embodiment, at least two of the at least two partial casings are made of different materials. Thus, the respective materials of the partial casings can be matched to their respective functions which in turn is related to the part of the product which the respective partial casings surround.

In terms of production-engineering, it may be advantageous if a first partial casing of the at least two partial casings surrounds the internal space and the length of the first partial casing is equal to the length of the internal space. Thus, during production, a long strand of the material of the first partial casing may be produced which is provided with the flavoring material on the inside of the strand material. Subsequently, this strand may be divided, in a continuous process, into lengths forming semi-finished products which are equal to the length of the internal space in the final product. The semi-finished products may subsequently become part of the product during a subsequent production step.

In a further embodiment, a second partial casing of the at least two partial casings surrounds the first retaining body and the second partial casing also surrounds the first partial casing over a part of the length of the first partial casing for the sake of this subsequent production step.

In addition thereto, the casing may comprise at least three partial casings in which a third partial casing of the at least three partial casings surrounds the second retaining body as well as the first partial casing over a part of the length of the first partial casing.

Specifically for preparing tea as described above, the flavoring material may be selected from the group consisting of natural leaves, such as tea leaves and herb leaves, or at least of comminuted parts of such leaves. Such flavoring material may also be referred to by the term extraction material. Alternatively, it is also conceivable for the flavoring material to dissolve and/or for a combination of soluble flavoring material and extraction material to be used.

If, according to a possible embodiment, the flavoring material occupies the entire volume of the internal space, the flavoring material can contribute to the rigidity of the product, as a result of which the material of the casing may be selected to be thinner or at least to be less rigid and therefore more flexible. It will be clear that there is no longer space between the flavoring material particles in this embodiment, but that such particles do not have any space within the internal space to move inside the internal space.

In a further embodiment, the flavoring material, such as the natural leaves or comminuted parts thereof, is compressed. Just as in the previous embodiment, compressing the flavoring material in the internal space offers the advantage that the flavoring material can contribute to the rigidity of the product. Compressing the flavoring material may offer the further advantage that flavoring material which is situated in the internal space at a distance from the outer side thereof, is not directly exposed to hot liquid, such as boiling water, but that this liquid only reaches the respective flavoring material after having cooled down to some degree, which may benefit the quality or the flavor of the beverage. This advantage may be relevant, in particular, when preparing green tea. In addition, the compressed flavoring material reduces dripping of liquid after the product has been removed from the liquid. It is known that a consumer, when using tea bags, squeezes them after he has removed them from the water in order to prevent dripping. This squeezing is an awkward procedure for the consumer and is also associated with a risk of spilling. In the case of tannin-containing tea, the squeezed liquid contains a relatively large amount of tannin, resulting in a more bitter tea. In general, it is true to say that, due to the fact that it is in a compressed state in the internal space, the flavoring material cannot move freely in this internal space, for example if the product is shaken, like tea in a tea bag can. Because it is compressed, the flavoring material takes up a smaller volume in the internal space, namely the volume of the internal space, than if the flavoring material would not be enclosed in this internal space or at least than before the flavoring material was enclosed in the internal space.

In particular in order to achieve an increased degree of security that flavoring material does not escape inadvertently from a semi-finished product as described above during production of a product according to the invention, it may be advantageous, in a further embodiment, if the flavoring material is compressed to a higher degree on at least one of two mutually opposite ends, preferably on two mutually opposite ends, of the internal space than in the center of the length of the internal space.

In order to achieve a desired degree of compression of the flavoring material, it may be advantageous if the compressed flavoring material in the internal space is provided in a partial casing, which partial casing is made of a liquid permeable material and which partial casing is provided on the inside of the tubular casing. In a first production step, the flavoring material may then be compressed and accommodated in the partial casing, after which the material of the tubular casing is wound around the partial casing in a subsequent production step. The tubular casing may in this case even be regarded as a partial casing as well, in the sense that the tubular casing is not the only casing of the product.

Although the product is in particular suitable for preparing tea, the product is in principle also suitable for preparing other kinds of beverages. In this context, the flavoring material may be selected from the group of granules and powders, such as soup powder, stock powder or coffee powder.

In particular, in order to render the product suitable for production on machines and using techniques which are already known for producing cigarettes, the casing may comprise a sheet which has been deformed to form a tubular shape and areas of which adjoin mutually opposite longitudinal edges of the sheet are connected to each other.

In this case, the respective areas may overlap and/or may be connected to each other by means of gluing and/or ultrasonic sealing. The areas may also be connected to each other by means of heat-sealing, in which case they are connected to each other by being pressed together assisted by heating. In case of overlapping areas, it generally holds true that the connection between these overlapping areas is less critical along the longitudinal edges in the sense that any intended or unintended short interruptions in the connection which should extend along the entire length of the longitudinal edges does not have to result directly in rejection of the product or at least to the product not being able to function well.

The cohesion and rigidity of the product may further benefit if the first retaining body and/or the second retaining body on the one hand and the casing on the other hand are connected to each other, for example by means of gluing, heat-sealing and/or ultrasonic sealing. Connecting the first retaining body and/or the second retaining body on the one hand and the casing on the other hand to each other may be brought about in the same production step as connecting the areas which border mutually opposite longitudinal edges of the sheet.

In a further embodiment, openings are provided in the or at least a material of the tubular casing to allow liquid through. In so far as the expression "the or at least a material" is used below in relation the material of the casing, this is understood to mean the situation where either the casing is made as a single piece and is made of only one material for this reason, or the casing comprises more than one partial casings which are all made of the same material, or the casing comprises more than one partial casings in which case the material of at least two of these partial casings differ from each other.

In one embodiment, the openings in the or at least a material of the casing are provided in a, preferably regular, pattern. By means of a regular pattern, which may be the case, for example, with a gauze or fabric or with perforated holes, it is possible to achieve a homogenous, predictable way of preparing a beverage, in particular if, according to a further possible embodiment, the openings are provided in a regular pattern.

In a further embodiment, the openings in the or at least a material of the casing are provided distributed across the entire periphery of the casing, as a result of which the product can release flavorings in every lateral direction.

The openings in the casing may be perforated openings. The perforations may be brought about, for example, by means of mechanical perforation, laser perforation or electrostatic perforation.

In a further embodiment, the or at least a material of the casing is gauze-like. Such a gauze-like material may, for example, also be a sheet as described above.

If the or at least a material of the casing is transparent, the consumer can see the flavorings, such as tea leaves, as a result of which the consumer may regard the product as being more natural and/or attractive.

The transparency of the or at least a material of the casing may furthermore be advantageous if the product is provided with an information body on the inside of the casing, such as a sheet containing information which is legible through the casing. The respective information may be, for example, a respective information may be, for example, a brand indication or a simple manual.

In order to be able to prepare the beverage sufficiently quickly, the or at least a material of the casing preferably has a CU value of a magnitude of at least 1000 or at least 2500 $cm^3$ per minute. More preferably, the CU value is between 3000 cm3 per minute and 50,000 cm3 per minute. As the person skilled in the art knows, the CU (Coresta Unit) value is defined as the volume flow of air which flows through a sample or substrate of 1 $cm^2$ at an applied pressure difference of 1 kPa.

In general, it furthermore holds true that the material of the casing may be woven.

In a further embodiment, the product comprises a gripping body which is provided on the inside of the casing and on the outside of the internal space. At the location of this gripping body, the consumer can grip the product in order to stir the product in the liquid. Incidentally, it is also conceivable for at least one of the two retaining bodies to have a length such that a consumer could grip it.

In one embodiment, the shape and size of the periphery of a cross section of the gripping body are identical to the shape and size of the periphery of a cross section of at least one, preferably each, of the first retaining body and the second retaining body.

In order to limit the consumption of material, the gripping body may be largely or completely hollow.

When using partial casings as already explained above, a partial casing surrounds the gripping body at least over part of its length, preferably over its entire length, and this partial casing is made of a different material than the material of the partial casing which surrounds the internal space.

In a further embodiment, the material of the partial casing which surrounds the internal space is provided with openings to allow liquid through and the material of the partial casing which surrounds the gripping body is not provided with such openings.

From an environmental point of view, it may be advantageous if the or at least a material of the casing and/or the material of at least one of the two retaining bodies and/or the material of the gripping body is biodegradable, such as compostable, in which case the material is biodegraded, for example, for 95% within twelve weeks, in an industrial composting installation in accordance with European directives EN 13432 and EN 14995.

It is furthermore possible, in particular if the respective material or the respective materials are biodegradable, for the or at least a material of the casing and/or the material of at least one of the two retaining bodies and/or the material of the gripping body to comprise cellulose fibers. Such a material may be wood-based, as is the case with paper, but may also be based on natural leaves, such as tea leaves, which were, for example, left as waste before when harvesting tea leaves.

A suitable embodiment of the product may be obtained if the or at least a material of the casing and/or of at least one of the two retaining bodies and/or of the gripping body comprises a polyester of a hydroxyalkanoic acid.

In a preferred embodiment, the hydroxyalkanoic acid is selected from the group consisting of lactic acid, 3-hydroxyvaleric acid valerate, 3-hydroxybutyric acid butyrate, 4-hydroxybutyric acid butyrate. Another name for lactic acid is 2-hydroxypropionic acid. Another name for 3-hydroxyvaleric acid is 3-hydroxypentanoic acid. Another name for 3-hydroxybutyric acid is 3-hydroxybutanoic acid. Another name for 4-hydroxybutyric acid is 4-hydroxybutanoic acid. All these acids occur in both a D form and an L form or a racemic mixture. Polymers of this acid are polylactic acid (polymer of lactic acid) and polyhydroxyalkanoates (collective name for various polymers, such as poly-3-hydroxybutyrate poly-4-hydroxybutyrate and poly-3-hydroxyvalerate). In a preferred embodiment the polyester is selected from the group consisting of polylactic acid, and polyhydroxyalkanoate.

The term polylactic acid also includes composites of polylactic acid and talcum, which are also referred to as C-PLA or crystallized Poly Lactic Acid. Usually, polylactic acid composites contain approximately 20-30% by weight of talcum and 70-80% by weight of polylactic acid.

In an embodiment, the or at least a material of the casing and/or of at least one of the two retaining bodies and/or of the gripping body consists for at least 60% by weight of the polyester, in particular for at least 70% by weight or at least 80% by weight or at least 90% by weight. In a further embodiment, the material of the casing and/or of at least one of the two retaining bodies consists for at least 95% by weight of the polyester, such as at least 98% by weight or 99% by weight or consists entirely of polyester.

In order to make the product suitable for use with boiling water, it may be preferable for the or at least a material of the casing and/or of at least one of the two retaining bodies and/or the material of the gripping body, and preferably each of these materials, to be heat-resistant to at least 100 degrees Celsius. Exposure of the product to boiling water will then not result in a loss of dimensional stability, or at least not a substantial loss of dimensional stability, of the product.

In a further embodiment, the shape of the periphery of the product is constant over the entire length of the product. This may be advantageous for producing the products and in order to arrange the products in a compact manner, for example in a packaging.

The cross section of the casing may furthermore be free from corners, and in this case have, for example, a cylindrical shape.

In order to be suitable for most containers, such as mugs, in which a beverage is prepared, the size of the product, viewed in the length direction of the tubular shape of the casing, is between 60 mm and 170 mm.

Furthermore, in an embodiment, the cross section of the product may fit in a circle whose radius has a size of between 4.0 mm and 10 mm.

The practical usefulness of the product may be influenced positively if the internal space extends to at least 75%, preferably to at least 90%, more preferably entirely on one side of the center of the length of the product. Thus, it can easily be ensured that the internal space is entirely immersed in a liquid, but that a part of the product also remains outside the liquid, so that it can be gripped.

In a further embodiment, the product does not comprise more than one internal space.

It is also possible for the first retaining body and the second retaining body to be provided entirely on the inside of the casing, as a result of which the casing may contribute to a good cohesion between the first retaining body and the second retaining body.

In a particular embodiment, the or at least a material of the casing is provided with further flavorings in order to release these, when immersed in the liquid, into the liquid in order to prepare the beverage. Thus, the casing itself may also contribute to imparting flavor to a beverage.

The invention furthermore relates to the use of a product according to the invention as described above for preparing a beverage by immersing the internal space of the product in a liquid.

The invention also relates to a method for producing a product having a first partial casing and a second partial casing and having a gripping body as described above. The method comprises the following steps:

A providing a semi-finished product comprising a first partial casing with a flavoring material, such as compressed tea leaves, on the inside thereof;

B after step A, aligning the semi-finished product with at least one gripping body;

C after step B, surrounding the combination of the semi-finished product and the gripping body with a second partial casing along at least a part of the length of the gripping body, such as along the entire length of the gripping body, and along a part of the length of the entire length of the semi-finished product.

In an embodiment, for the purpose of step A, the semi-finished product is separated from a strand from which a plurality of semi-finished products can be separated. Such a method may be particularly advantageous in large-scale production, at least with regard to production efficiency.

In a further embodiment, the semi-finished product also comprises at least one first retaining body and preferably also a second retaining body, wherein the at least one retaining body of the first retaining body and the second retaining body is provided on the inside of the first partial casing.

Figure 2:
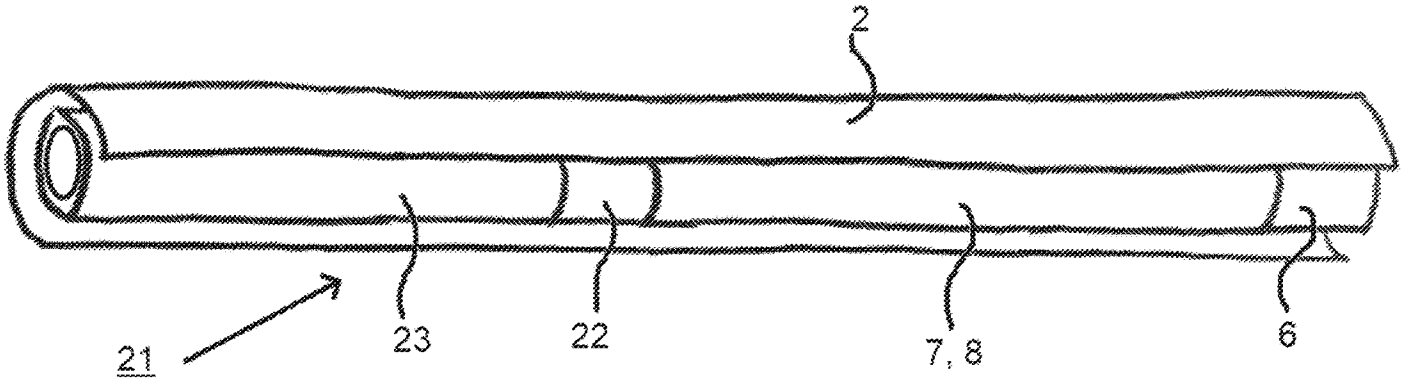
Figure 3:
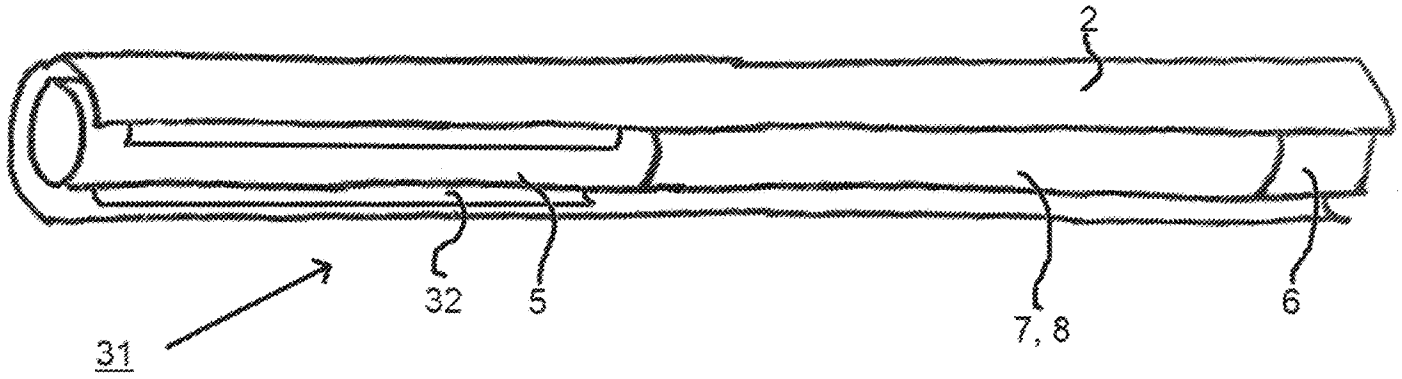
Figure 4A:
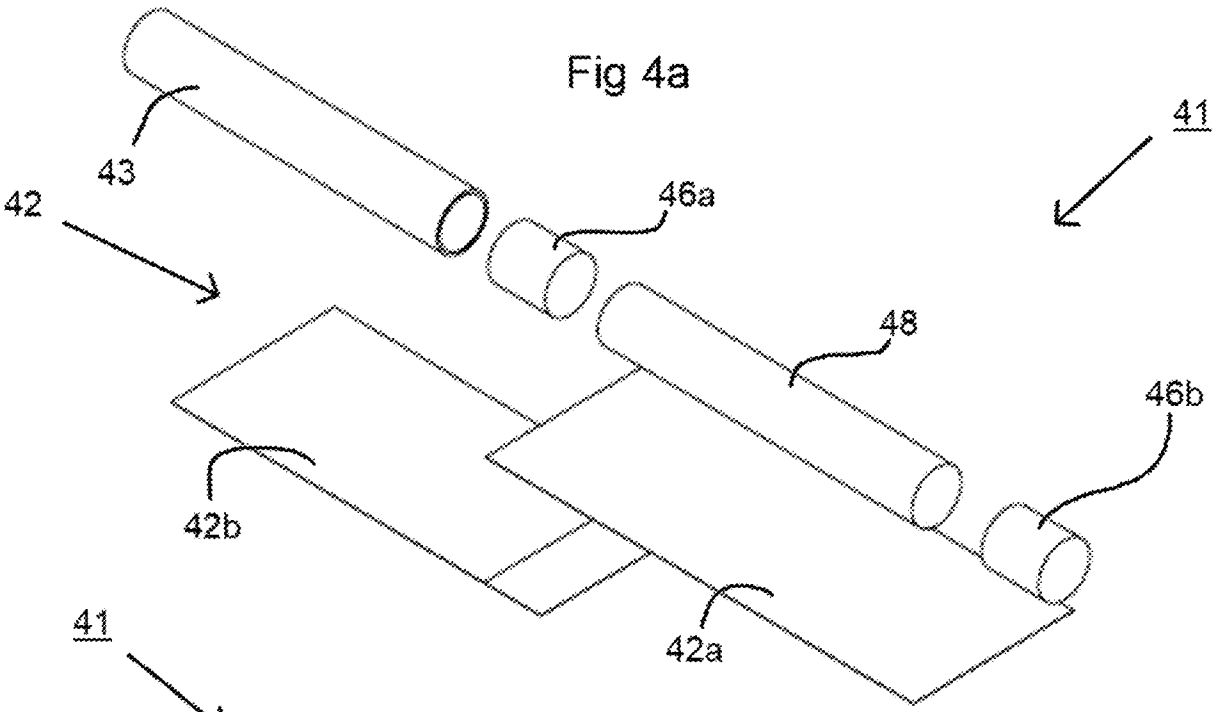
Figure 4B:
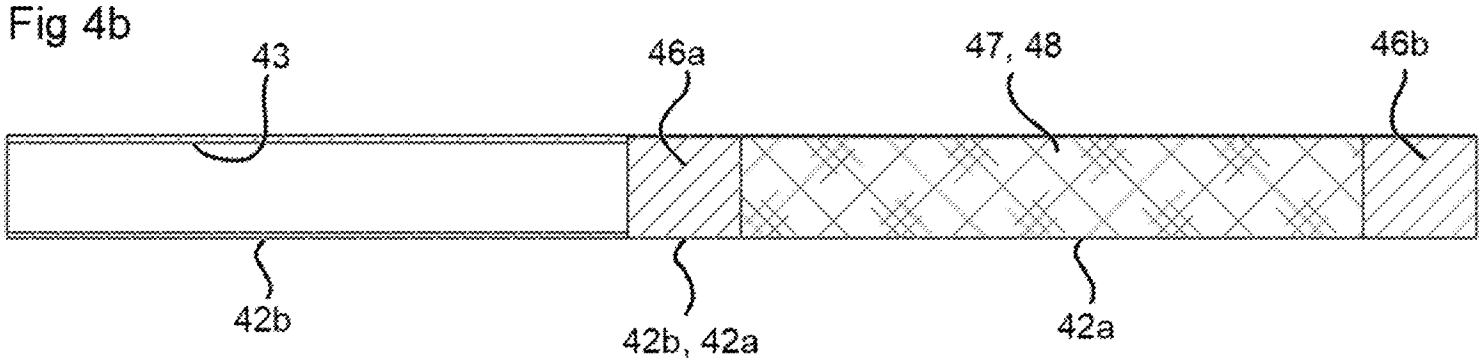
Figure 5A:
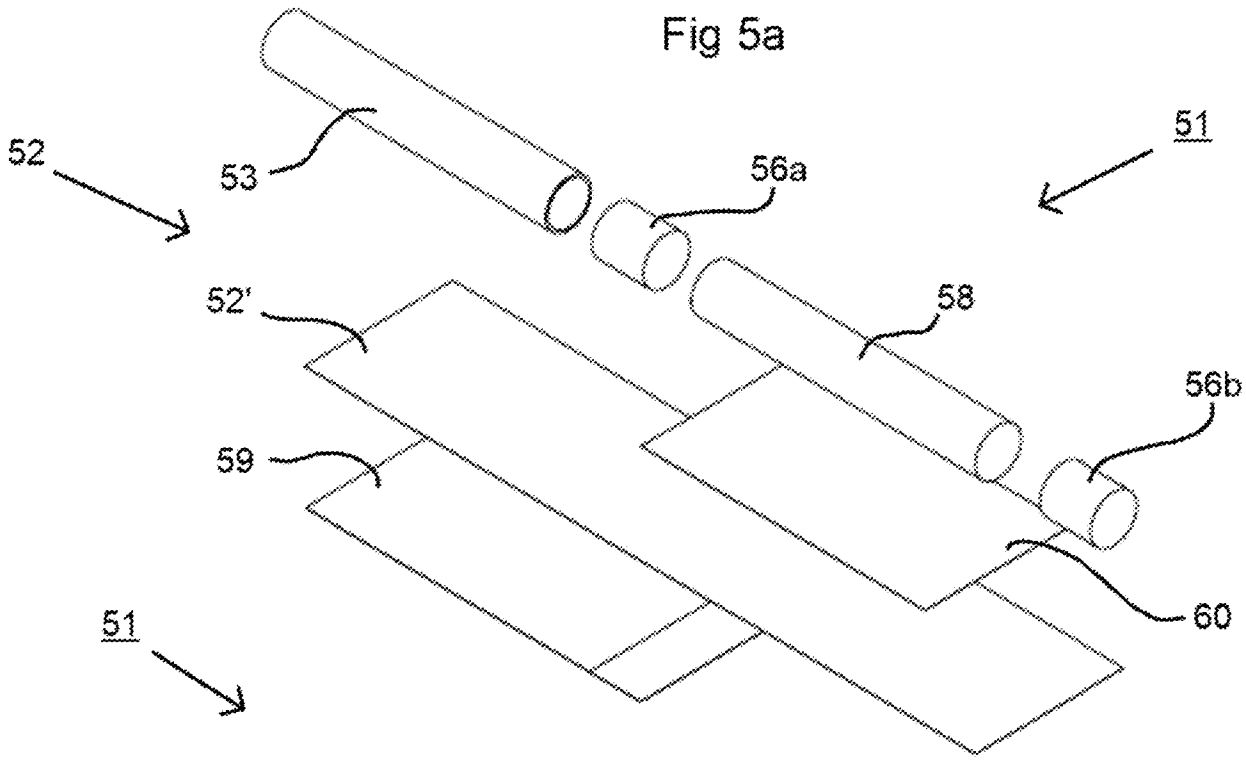
Figure 5B:
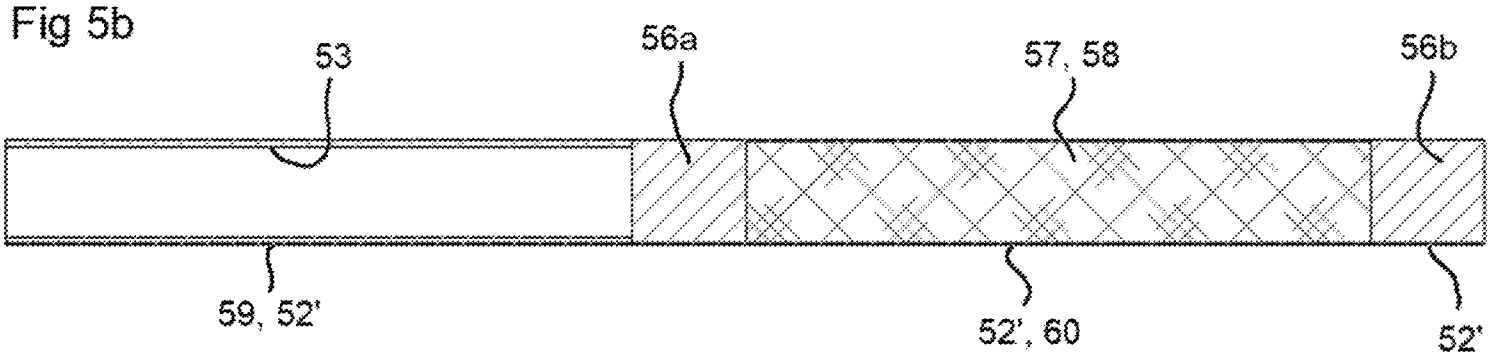
Figure 6A:
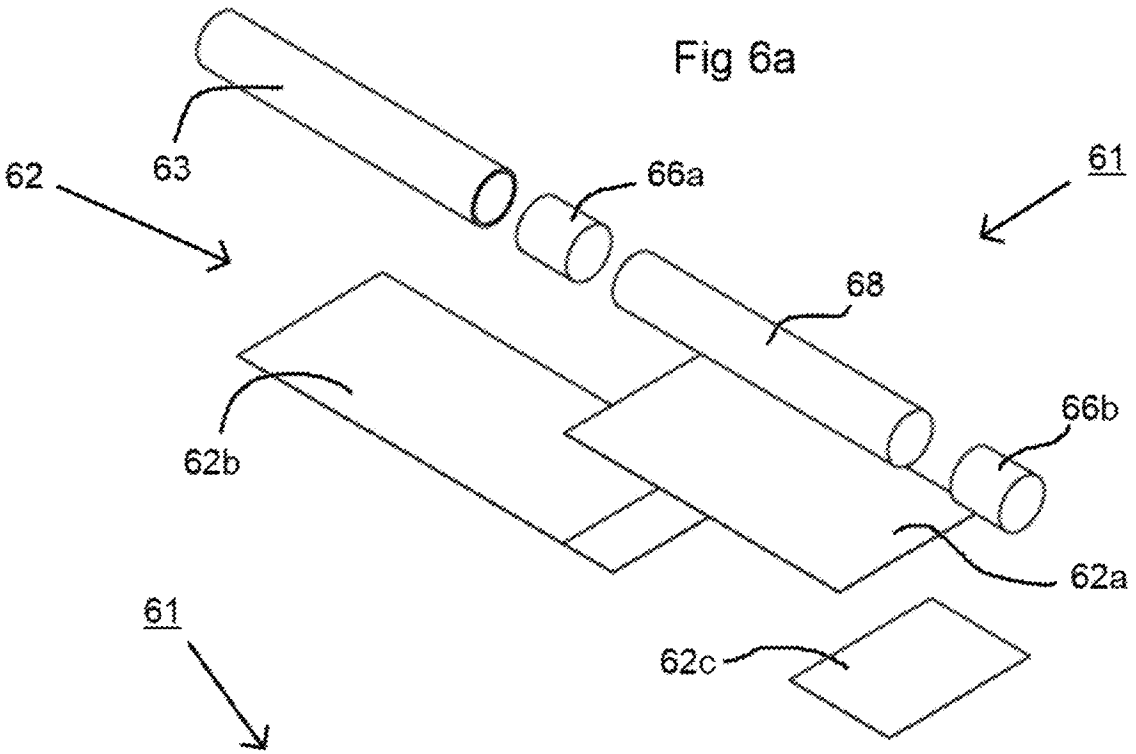
Figure 6B:
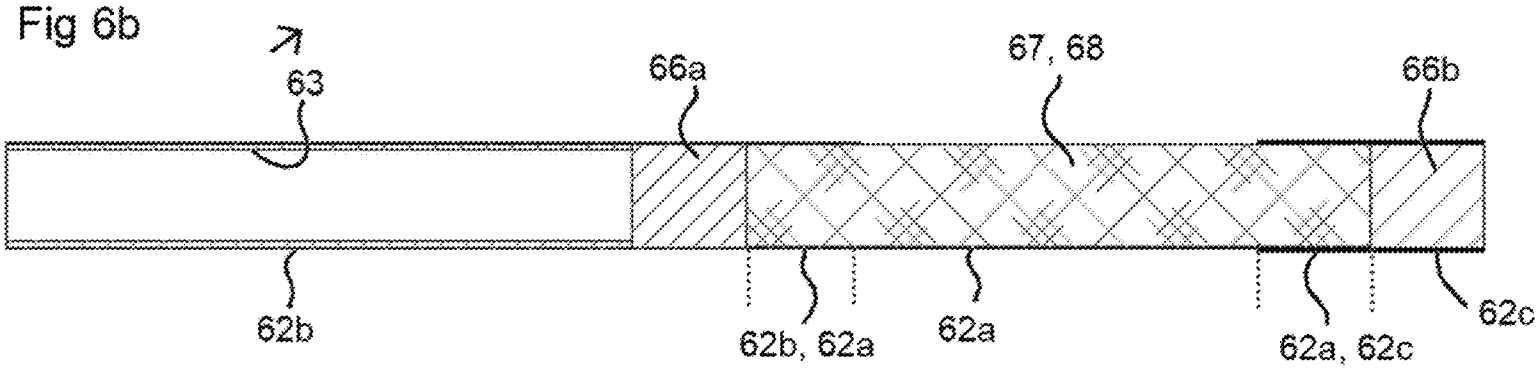

The invention will be explained further by means of the description of possible embodiments of a product according to the invention with reference to the schematic FIGS. 1 to 3 and to FIGS. 4*a* to 7*b*, in which:

FIGS. 1 to 3 show cut-away representations in isometric view of a first, second and third embodiment, respectively, of a product according to the invention;

FIGS. 4*a* and 4*b*, 5*a* and 5*b* and 6*a* and 6*h* show a fourth, fifth and sixth embodiment, respectively, of a product according to the invention, in which FIGS. 4*a*, 5*a* and 6*a* show the respective embodiments in separate parts thereof and FIGS. 4*b*, 5*b* and 6*b* show the respective embodiments in longitudinal section.

FIG. 1 illustrates a product 1 for preparing tea. The product has the shape and size of a cigarette. More specifically, the product has a cylindrical shape with a length of between 60 mm and 170 mm, for example 80 mm, and a diameter of between 4.0 mm and 10 mm, for example 5.0 mm. The product 1 is also similar to a cigarette in the sense that the product comprises a tubular casing 2, just like a cigarette. However, the material of the casing 2 clearly differs from that of the casing of a cigarette and is a gauze provided with meshes. The gauze is made of biodegradable material, more specifically of a composite of polylactic acid and talcum, and is heat-resistant to at least 100 degrees Celsius. The air permeability expressed by the CU value (Coresta Unit) is at least 2500 cm3 per minute, for example 15,000 $cm^3$ per minute.

Although the longitudinal edges 3, 4 of the casing in FIG. 1 are shown a distance apart in order to render the interior of the product 1 more visible for the sake of a good understanding, strips which, for example, have a width of between 0.5 mm and 5.0 mm, such as 1.0 mm, and extend parallel to the longitudinal edges overlap in the product 1 and these strips are connected to each other by means of adhesive bonding. Alternatively, this connection may also be achieved by means of ultrasonic sealing, in which case it is alternatively furthermore also possible for said overlap to be present but for the longitudinal edges 3, 4 to be positioned against each other and for the connecting weld to be achieved at the location of the abutting longitudinal edges 3, 4.

On the inside of the tubular casing 2, the product 1 comprises two cylindrical retaining bodies 5, 6 which are situated a distance apart and which, together with the casing 2, delimit a cylindrical internal space 7 in between. The ends of the retaining bodies 5, 6 which are turned away from each other are situated a distance apart which equals the (axial) length of the casing 2 or the length of product 1. The length of retaining body 5 is greater than the length of retaining body 6 as a result of which (the center of) the internal space 7 is situated outside the center of the length of the product 1. The length of retaining body 5 is greater than 2.5 cm, for example 4.0 cm, so that a consumer can grip the product 1 at the location of the retaining body 5 in order to stir the product 1 in water and thus to prepare tea, as will become clearer below. The material of the retaining bodies 5 and 6 may be identical to that of the casing 2 and may generally preferably be biodegradable. The retaining bodies 5 and 6 are connected to (the inside of) the casing 2 by means of one of a number of adhesive connections. Alternatively, it is also possible for the retaining bodies 5 and 6 to be connected to the casing 2 by means of ultrasonic sealing which may optionally be performed at the same production stage as the ultrasonic sealing of the longitudinal edges 3, 4 or at least of strips which run parallel to these longitudinal edges of the casing 2, as described above. The connection between the retaining bodies 5 and 6 on the one hand and the casing 2 on the other hand contributes to the rigidity and thus the dimensional stability of the product 1.

Flavoring material in the shape of compressed tea leaves 8 is provided in the internal space 7 and these tea leaves 8 are stored in the internal space 7 via the casing 2 and the two retaining bodies 5, 6 and completely fill the volume of the internal space 7, so that they cannot move through the internal space 7. The fact that the internal space 7 is completely filled by the tea leaves 8 and that the tea leaves 8 are compressed contributes to the rigidity of the product 1, so that the latter retains its shape during normal use in which the product 1 is gently stirred in a glass of heated water. For the purpose of stirring the product 1, the product 1 may be gripped by a user at the location of the extended retaining body 5.

In order to make it possible to compress the tea leaves 8 to a greater degree, it is also possible in the context of the invention for the tea leaves to be encased surrounded by a partial casing (not shown) before they are surrounded by the casing 2 during the production process of the product. The tea is then introduced separately in a long cylindrical strand in the partial casing and is subsequently cut from the strand to the same length as the length of the internal space 7. Subsequently, the gauze of the casing 2 is then wound around this partial casing which was cut to size and comprises the compressed tea leaves and turned into casing 2. In this case, the material of the partial casing may be the same or at least may be of the same type as the material of the casing 2. The material of the partial casing will in any case be water-permeable, just as casing 2, and will preferably have openings to this end in order to allow water to pass through.

Product 21 from FIG. 2 is largely similar to product 1 from FIG. 1. Parts of product 21 which correspond to those from FIG. 2 are denoted by the same reference numerals in FIG. 2 and are not explained in any more detail in the present description of FIG. 2. Product 21 differs from product 1 in that retaining body 5 has been replaced by a cylindrical retaining body 22 which is significantly shorter than retaining body 5 and has, for example, the same length as retaining body 6, and by a tubular gripping body 23 which is aligned with the retaining body 22. The sum of the lengths of the retaining body 22 and the gripping body 23 is equal to the length of the retaining body 5. Since the gripping body 23 is hollow, product 21 contains less material than product 1.

In a further variant of product 21 according to FIG. 2, the length of the retaining body 6 is shortened, for example to the left half (in FIG. 2) of the retaining body 6, and a tubular filling body is provided on the right-hand side of the retaining body 6 or at one end of the product which is made of the same material as the gripping body 23, but which is shorter.

Product 31 from FIG. 3 only differs from product 1 in that a sheet 32 is provided between retaining body 5 and casing 2. On the side of sheet 32 facing the casing 2, information is displayed, for example relating to the flavoring material 8 and/or a logo or brand indication or the like. Since casing 2 is made of gauze-like material, this information is legible to a consumer through the openings in the gauze, just like the flavoring material 8 is visible in the internal space 7. Although the sheet 32 with product 31 is shorter than retaining body 5, the respective lengths may also be equal.

Products 41, 51, 61 are identical in shape and correspond to each other due to the fact that they, from their end which, in use, is at the top, successively comprise a tubular gripping body 43, 53, 63, a first retaining body 46*a*, 56*a*, 66*a*, compressed tea leaves 48, 58, 68 and a second retaining body 46*b*, 56*b*, 66*b* on the insides of the respective casings 42, 52, 62. The compressed tea leaves 48, 58, 68 are provided in a respective internal space 47, 57, 67 which extends between the associated pairs of retaining bodies 46*a*, 46*b*, 56*a*, 56*b* and 66*a*, 66*b* and which internal spaces 47, 57, 68 are surrounded by the associated casing 42, 52, 62. The products 41, 51, 61 differ from each other with regard to the embodiment of the respective casings 42, 52, 62.

Gripping bodies 43, 53, 63 and the retaining bodies 46*a*, 56*a*, 66*a* and 46*b*, 56*b*, 66*b* may be made of paper of a quality which, when immersed in water, does not immediately cause the gripping bodies and retaining bodies to lose their respective shape. The gripping bodies may, for example, at least substantially be in the shape of a straw, in which case the material may be made of paper or cardboard or may generally comprise cellulose fibers, for example based on natural leaves, such as tea leaves. In this case, the gripping bodies may be made of a single layer, but may also be made of multiple layers, such as two layers or three layers, and may, for example, be made of strips which have been wound in a spiral shape. Alternatively, the material of the gripping bodies may also comprise polylactic acid or polyhydroxyalkanoate because of their biodegradable properties.

It applies specifically to the retaining bodies 46*a*, 56*a*, 66*a* and 46*b*, 56*b*, 66*b* that they could be designed, for example, as a filter like the one which is made commercially available for the tobacco industry by Essentra under the name OCHRE filter. Such filters degrade relatively quickly, for example three times quicker than filters made of cellulose acetate.

Casing 42 of product 41 comprises a partial casing 42*a* and a partial casing 42*b*. Both partial casings 42*a* and 42*b* were originally sheet-shaped. In the product 41, they have been rolled to form a cylinder, with the respective longitudinal edges of each of the partial casings 42*a* and 42*b* overlapping each other and being connected to each other in these respective overlap areas. Partial casing 42*a* has a length which is equal to the distance between the ends of retaining bodies 46*a* and 46*b* which face away from each other and surrounds the internal space 47 containing the compressed tea leaves 48. The length of partial casing 42*b* is equal to the distance between the ends of gripping body 43 and the first retaining body 46*a* which face away from each other. At the location of the first retaining body 46*a*, partial casing 42*b* overlaps partial casing 42*a* on its outside. Partial casing 42*b* does not surround the internal space 47. At the location of the abovementioned overlap between partial casings 42*a* and 42*b*, these partial casings 42*a*, 42*b* are connected to each other, for example by means of an adhesive connection or by means of ultrasonic sealing. Partial casing 42*a* itself is also connected to the retaining bodies 46*a* and 46*b*, likewise, for example, by means of adhesive bonding or ultrasonic sealing. Partial casing 42*b* is also connected to gripping body 43, for example by means of one of the abovementioned connecting techniques. The materials of partial casings 42*a* and 42*b* differ from each other. It is of vital importance for partial casing 42*a* that the material from which it is made is permeable to liquid. Suitable materials for partial casing 42*a* may be, for example, a gauze and/or may be woven. Alternatively, the sheet from which partial casing 42*a* is made may be provided with perforations, for example perforations produced by mechanical means, perforations made by means of a laser or perforations made by electrostatic means. The size of these perforations may be such, for example, that such perforations could not fit in a circle having a diameter of at least 0.05 or 0.10 mm and could fit in a circle having a diameter of at most 0.75 mm or 0.50 mm. Perforations which are too small could result in the material of the partial casing 42*b* no longer being permeable to liquid/water. During production of product 41, first a semi-finished product may be formed consisting of the combination of the retaining bodies 46*a* and 46*b*, the compressed tea leaves 48 and the partial casing 42*a*. During a further stage, this semi-finished product may be aligned with the gripping body 43, following which partial casing 42*b* is wound around both that gripping body 43 and a part of partial casing 42*a* and connected thereto. There is no specific reason to choose material of partial casing 42*b* to be also permeable to liquid. It may be decided to choose the material of partial casing 42*b* not to be permeable to liquid, if the materials of retaining body 46*a* and gripping body 43 were only resistant to liquid in the sense that they would lose their dimensional stability relatively quickly if they were to be immersed in a liquid.

The casing 52 of product 51 consists of a partial casing 60, a partial casing 52' and partial casing 59. The length of partial casing 60 is equal to the distance between the mutually facing ends of retaining bodies 56*a*, 56*b*. The length of partial casing 52' is equal to the length of the product 51 or to the distance between the ends of gripping body 53 and of the retaining body 56*b* which face away from each other. The length of partial casing 59 is equal to the distance between the ends of gripping body 53 and retaining body 56*a* which face away from each other. The materials of partial casings 60 and 52' are permeable to liquid. The material of partial casing 59 may be permeable to liquid, but this is not obligatory. The combination of the compressed tea leaves 58 and partial casing 60 as wound around these compressed tea leaves 58 may serve as a semi-finished product during the production of product 51. In order to prevent tea leaves 58 from inadvertently falling from the open ends of the partial casing 60 of the semi-finished product, it may be decided to compress the tea leaves 58 near the open ends more forcefully. The semi-finished product may be aligned with the gripping body 53 and the retaining bodies 56*a*, 56*b*, during a subsequent stage of production, after which the partial casing 52' may be wound around these and be connected to the parts of product 51 located on the inside of partial casing 52'. During yet a further stage, partial casing 59 may be wound around the partial casing 52' and connected thereto. Information may be displayed, for example regarding the brand of the product 51 (41) and the type of the compressed tea leaves 58 (48), on the outside of partial casing 59, as may incidentally also be done on the outside of partial casing 42*b*.

Casing 62 of product 61 consists of three partial casings 62, 62*b*, 62*c*. Partial casing 52*a* has a length which is equal to the distance between the two mutually facing ends of retaining bodies 66*a*, 66*b* and may form a semi-finished product together with the compressed tea leaves 68, as has also been described for product 51. The material of partial casing 62*a* is permeable to liquid. The length of partial casing 62*b* is slightly greater than the distance between the ends of gripping body 63 and retaining body 66*a* which face away from each other. The length of partial casing 62*c* is greater than the length of retaining body 66*b*, for example twice as large. The partial casings 62*b* and 62*c* overlap the outside of partial casing 62*a* and thus each also extend along part of the length of the internal space 67. In particular for this reason, it may be desirable for the material of the partial casings 62*b* and 62*c* to also be permeable to liquid, just like a material of partial casing 62*a*, which does not necessarily mean that the material of partial casing 62*a* is the same material as that of the partial casings 62*b* and 62*c*.

Products 1, 21, 31, 41, 51 and 61 may be manufactured using existing production machines for cigarettes. Such production machines do not require any modifications to this end, or only very limited modifications. This is the result of the fact that the respective products comprise similar components and have a similar overall construction as cigarettes.

The invention is not only, albeit in particular, suitable for preparing tea, but also for other types of beverages. The flavoring material comprises, for example, fruit or fibers and/or may also be soluble in water. Specifically, it is pointed out with regard to the preparation of cold infusions that, in contrast to the tea bags which are used according to the prior art for preparing cold infusions and have a tendency to float for a relatively long period of time on the water, the respective product according to the invention can easily be immersed in water, in particular if the respective product comprises compressed infusion material.

The invention claimed is:

1. A product for preparing a beverage for consumption, the product comprising:

a tubular casing comprising a material permeable to liquid, and an internal space, wherein the tubular casing comprises at least two partial casings;

a first retaining body inside the tubular casing and a second retaining body inside the tubular casing, wherein the first retaining body and the second retaining body delimit the internal space on mutually opposite ends thereof;

flavoring material in the internal space for preparing a beverage and which, when immersed in the liquid, such as water, releases flavorings into the liquid for the purpose of preparing the beverage; and a gripping body inside of the tubular casing and outside of the internal space.

2. The product as claimed in claim 1, wherein at least one of the at least two partial casings has a length which is smaller than the length of the product.

3. The product as claimed in claim 1, wherein at least two of the at least two partial casings overlap one another for only a part of their respective lengths.

4. The product as claimed in claim 3, wherein two overlapping partial casings are connected to each other at the location of the overlap.

5. The product as claimed in claim 1, wherein at least two of the at least two partial casings are made of different materials.

6. The product as claimed in claim 1, wherein the flavoring material is selected from the group consisting of natural leaves, such as tea leaves and herb leaves, or at least of comminuted parts of such leaves.

7. The product as claimed in claim 1, wherein the flavoring material occupies the entire volume of the internal space.

8. The product as claimed in claim 1, wherein the flavoring material is compressed.

9. The product as claimed in claim 1, wherein the flavoring material is selected from the group of granules and powders, such as soup powder, stock powder or coffee powder.

10. The product as claimed in claim 1, wherein openings are provided in the or at least a material of the tubular casing to allow liquid through.

11. The product as claimed in claim 10, wherein the openings in the tubular casing or at least a material of the tubular casing are provided in a pattern.

12. The product as claimed in claim 10, wherein the openings in the tubular casing are perforated openings.

13. The product as claimed in claim 1, wherein the shape and size of the periphery of a cross section of the gripping body are identical to the shape and size of the periphery of a cross section of at least one of the first retaining body and the second retaining body.

14. The product as claimed in claim 1, wherein the gripping body is largely or completely hollow.

15. A method for using a product as claimed in claim 1 for preparing a beverage by immersing the internal space of the product in a liquid.

16. A method for producing a product as claimed and further comprising a gripping body which is provided on the inside of the tubular casing and on the outside of the internal space, the method comprising in claim 1:

A providing a semi-finished product comprising a first partial casing with a flavoring material, such as compressed tea leaves, on the inside thereof;

B after step A, aligning the semi-finished product with at least one gripping body;

C after step B, surrounding the combination of the semi-finished product and the gripping body with a second partial casing along at least a part of the length of the gripping body, such as along the entire length of the gripping body, and along a part of the length of the entire length of the semi-finished product.

17. A product for preparing a beverage for consumption, the product comprising:

a tubular casing comprising a material permeable to liquid, and an internal space;

a first retaining body inside the tubular casing and a second retaining body inside the tubular casing, wherein the first retaining body and the second retaining body delimit the internal space on mutually opposite ends thereof;

flavoring material in the internal space for preparing a beverage and which, when immersed in the liquid, such as water, releases flavorings into the liquid for the purpose of preparing the beverage; and a gripping body inside of the tubular casing and outside of the internal space, wherein a partial casing surrounds the gripping body at least over part of its length and is made of a different material than a material of a partial casing which surrounds the internal space.

18. The product as claimed in claim 17, wherein the material of the partial casing which surrounds the internal space is provided with openings for allowing liquid through and the material of the partial casing which surrounds the gripping body is not provided with such openings.

19. The product as claimed in claim 17, wherein the shape and size of the periphery of a cross section of the gripping body are identical to the shape and size of the periphery of a cross section of at least one of the first retaining body and the second retaining body.

20. The product as claimed in claim 17, wherein the gripping body is largely or completely hollow.

* * * * *